United States Patent [19]

Sherer et al.

[11] Patent Number: 4,961,497

[45] Date of Patent: Oct. 9, 1990

[54] GOLF BAG CONTAINER

[76] Inventors: Douglas H. Sherer, 7607 N. Moonlight La., Paradise Valley, Ariz. 85253; Fred M. Mills, 5529 S. Waverly Way, Tempe, Ariz. 85283

[21] Appl. No.: 318,242

[22] Filed: Mar. 3, 1989

[51] Int. Cl.[5] ..... A63B 55/00; B65D 6/00

[52] U.S. Cl. ..... 206/315.4; 206/315.2; 150/159; 220/8

[58] Field of Search ..... 206/315.1–315.4, 206/514, 517, 520; 220/4 D, 4 F, 8; 150/159; 190/107, 119, 120, 28

[56] References Cited

U.S. PATENT DOCUMENTS

| | | | |
|---|---|---|---|
| 1,325,692 | 12/1919 | Cross | 206/315.4 |
| 1,570,510 | 1/1926 | McQuirk | 206/315.4 |
| 2,008,759 | 7/1935 | Howard | 206/315.3 X |
| 2,919,017 | 12/1959 | Weber | 220/8 |
| 3,935,931 | 2/1976 | Kaplan | 220/4 F |
| 4,143,694 | 3/1979 | Gregory | 206/315.1 |
| 4,509,656 | 4/1985 | Rosler | 220/8 |
| 4,643,302 | 2/1987 | Baumgardner | 206/315.1 |
| 4,743,038 | 5/1988 | Myers et al. | 190/18 A X |

*Primary Examiner*—Sue A. Weaver
*Attorney, Agent, or Firm*—Tod R. Nissle

[57] ABSTRACT

A golf bag container is formed by separable upper and lower bodies. The bodies are configured to provide a union in which either (a) a short section of the open end of one of the bodies is received within the open end of the other body to provide a continuous storage space within the two bodies, or (b) a substantial portion of the closed end of the upper body is received in the open end of the lower body with the upper body inverted for storage purposes. The bodies are equipped with latches for holding them together and the union configuration has recessed regions for receiving the latches.

15 Claims, 1 Drawing Sheet

GOLF BAG CONTAINER

TECHNICAL FIELD

This invention is concerned with providing a protective container suitable for the shipment via public transport to golf clubs in a golf bag together with accessories used by the golfer.

BACKGROUND ART

The golf bags employed by golfers to transport their clubs around golf courses are usually made of lightweight materials, such as leather, plastic or fabric. These bags are not constructed to withstand the rigors of transport through a public transportation system such as an airline. Consequently, when the golfer travels from one place to another to enjoy the challenges of a different course he or she usually must encase the golf bag and the clubs in a protective cover or container to prevent the clubs and carrying bag from being damaged in transit.

Flexible canvas cover bags have been used by some traveling golfers, but they offer protection usually only against scuffing and scraping and allow the clubs or bag to be damaged by impact blows.

It is not too surprising, then, that others have proposed to provide rigid or semi-rigid containers for shipping golf bags and clubs. Two examples of such prior containers are disclosed in U.S. Pat. Nos. 4,143 694 granted Mar. 13, 1979 to F. S. Gregory for "GOLF BAG CONTAINER" and No. 4,643,302 granted Feb, 17, 1987 to E. W. Baumgardner for "CONTAINER FOR SPORTS EQUIFMENT". The Gregory bag is adapted especially for golf bag shipment while the Baumgardner container can be formed of two or more tubular sections for transporting other sporting equipment.

A design for another golf bag container is disclosed in an application for a U.S. design patent Ser. No. 07/012,631 filed Feb. 9, 1987 by D. H. Sherer and F. M. Mills for "GOLF BAG CONTAINER". That application is assigned to the same assignee as the present application.

One of the problems posed by these prior rigid containers is storage of the containers when they are not being used to transport the golf bag. These containers are bulky and take up a lot of space.

Some designers have, of course, produced containers with telescopic sections which permit the length of the container to be adjusted. See U.S. Pat. Nos. 2,919,017 granted Dec. 29, 1959 to F. H. Weber for "TELESCOPIC CARRYING CASE" and No. 4,509,656 granted Apr. 9, 1985 to Peter Rosler for "VARIABLE LENGTH PACKING CONTAINER ASSEMBLY". The packaging systems disclosed in both of these patents require means for interlocking the container sections in various telescopic positions. Such mechanisms are neither required for nor are they economically feasible for a golf bag container which can be of a fixed length. Another problem posed by the containers of the Gregory and Baumgardner patents identified above is that the latches employed to connect sections of the containers are exposed on the outer surfaces of the container and are subject to damage or even dislodgement as the containers are moved about in transport.

There continues to be a need for a reliable golf bag container which can be conveniently stored when not in use.

DISCLOSURE OF THE INVENTION

The golf bag container of this invention is composed of upper and lower hollow bodies with the lower body open at its top end and the upper body open at its bottom end. The open ends of the container bodies are configured to provide a union between the two bodies. This union permits the open ends of the bodies to be joined with only a short section of one body projecting into the other body. Latch members are provided for connecting the two bodies in this condition with the interiors of the two bodies proViding a continuous storage space for the golf bag and clubs.

The union also permits a substantial portion of the upper body to be positioned within the lower body when the former is inverted. In other words, the upper body can be stored in the lower body and then the golf bag can be placed inside the inverted upper body. This permits storage of the container in the space normally occupied by the golf bag and clubs but leaves the bag and clubs readily accessible for use.

BRIEF DESCRIPTION OF THE DRAWINGS

The invention is described in greater detail hereinafter by reference to the accompanying drawings wherein.

BEST MODE FOR CARRYING OUT THE INVENTION

Figure 1:
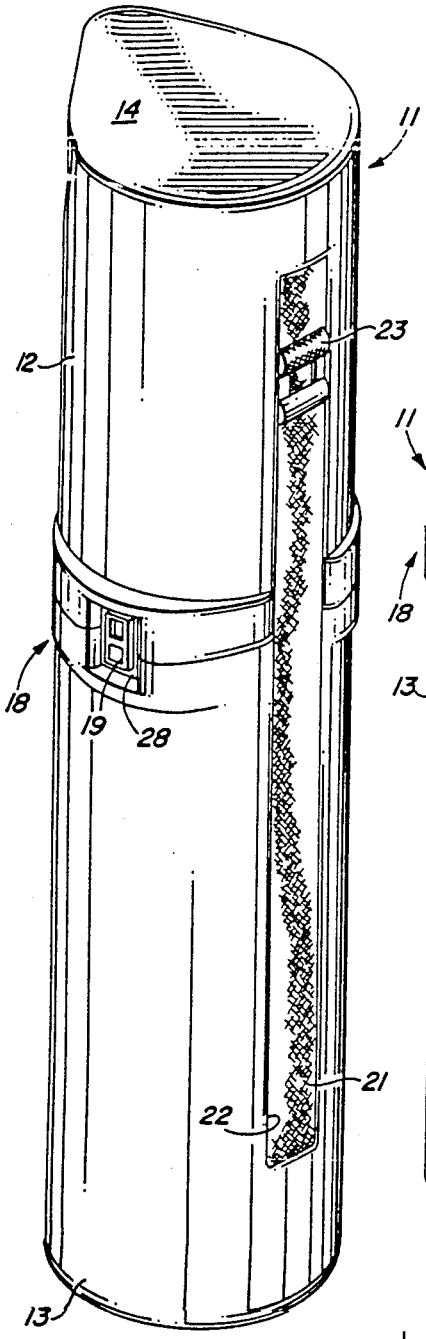
FIG. 1 is a perspective view from above of the container of this invention in closed condition in which it is used to transport a golf bag.

In the drawings the golf bag shipping container of this invention is indicated generally by reference numeral 11. Container 11 is comprised of a hollow upper body 12 and a hollow lower body 13. Upper body 12 has a closed top end 14 and an open bottom end 15. Similarly, lower body 13 has an open top end 16 and a closed bottom end 17. When the two bodies 12 and 13 are assembled open end to open end, as shown in FIG. 1, their interiors form a continuous storage space capable of housing a golf bag with clubs therein and other accessories used by the golfer.

Joinder of container bodies 12 and 13 is effected by union means indicated generally be reference numeral 18. Union means 18 is provided by special configurations of the open ends 15 and 16 of container bodies 12 and 13, respectively. The two bodies are held securely together during shipment of container 11 by latch means preferably in the form of a pair of toggle latches 19.

Manual carrying of container 11 is facilitated by providing an adjustable carrying strap 21 which is preferably positioned in elongated recesses 22 in the side walls of container bodies 12 and 13. The strap 21 preferably has an adjustable buckle arrangement 23 by which the strap can be shortened to serve as a carrying handle or lengthened to serve as an over-the-shoulder sling carrier. Buckle arrangement 23 can also be disconnected to permit separation of container bodies 12 and 13.

Figure 5:
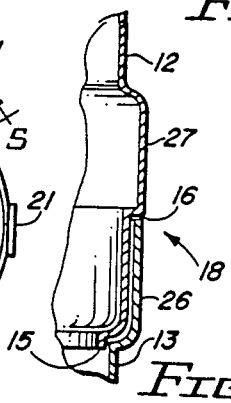
FIG. 5 is an enlarged fragmentary sectional view through the wall of the container taken generally as indicated by line 5—5 in FIG. 2.
Figure 6:
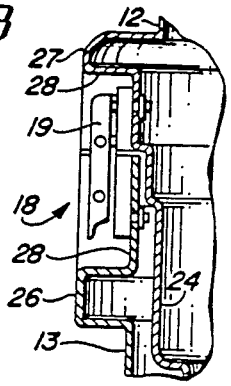
FIG. 6 is an enlarged fragmentary sectional view through the wall of the container taken generally as indicated by line 6—6 in FIG. 2.

Union means 18 which provides the connection between the container bodies 12 and 13 is shown in greater detail in FIGS. 5 and 6. The configuration of union means 18 includes a tubular section 24 at the bottom end 15 of upper body 12 which is adapted to fit tightly inside a sleeve 26 formed on the top end 16 of lower body 13. An enlargement, or protrusion, 27 above section 24 on upper body 12 is adapted to engage the top edge 16 of lower body 13 to limit the entry of section 24 into the lower body. The telescoping of short section 24 into the lower body 13 provides a strong union between the upper and lower bodies 12 and 13 which resist twisting and bending of the two bodies at the union means 18.

Sleeve 26 on lower body 13 and enlargement 27 on upper body 12 extend around the periphery of container 11 but are discontinuous in the vicinity of the carrying strap 21. In addition, sleeve 26 and enlargement 27 have recesses 28 therein for the latches 19. The raised portions of sleeve 26 and enlargement 27 surround and protect the latches 19 against being disengaged or dislodged when the container is scraped against other objects as the container is moved along conveyor belts, stacked in luggage compartments and otherwise handled in the transportation system.

Figure 4:
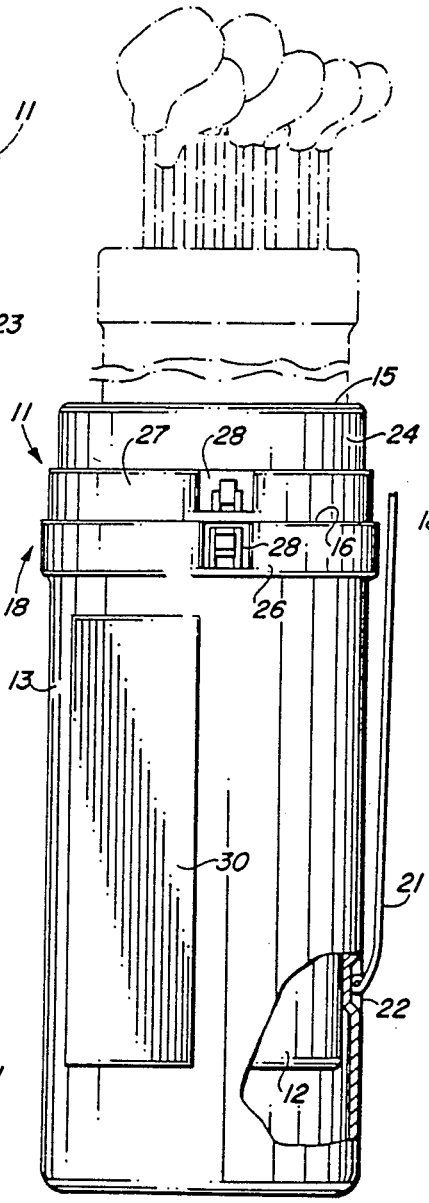
FIG. 4 is a side elevational view of the container with its upper body inverted and stored in its lower body.
Figure 3:
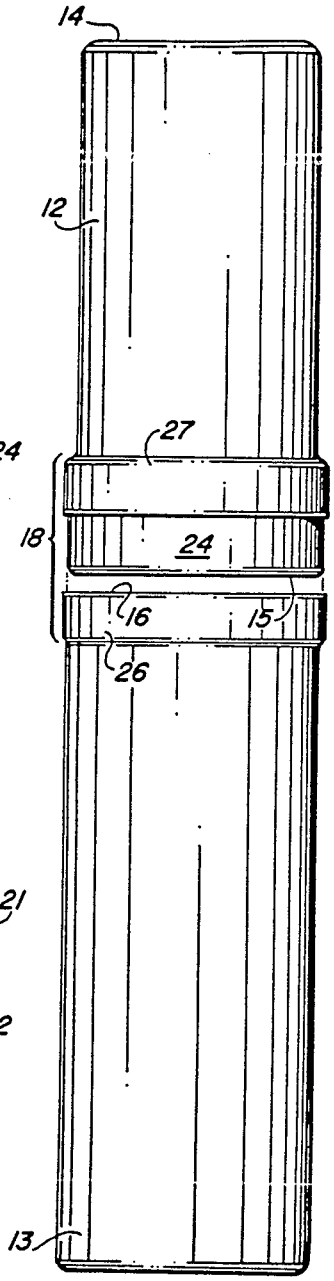
FIG. 3 is a front elevational view of the container with its upper body separated from its lower body.

When latches 19 are disengaged, the upper body 12 of the container 11 can be removed and then inserted and telescoped into the lower body 13 after removal of the golf bag from the lower body. A substantial portion of upper body 12 can enter the lower body 13 before the union enlargement 27 on the upper body engages the top 16 of the lower body. The bag containing the clubs (shown in phantom in FIG. 4) can be placed in the inverted upper body 12. The container 11 and the bag of clubs can thus be stored in a space barely larger than the bag and clubs themselves.

Figure 2:
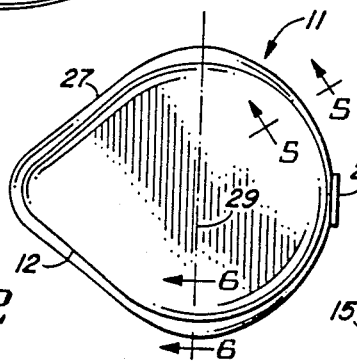
FIG. 2 is a top, or plan, view of the container.

In cross-section the container 11 preferably possesses a somewhat ovate configuration (see FIGS. 1 and 2) with one side being generally semi-circular and the other side presenting a rounded acute tip. This configuration offers several advantages. First, the resulting flat surfaces on container bodies 12 and 13 prevents the container from rolling when it is laid down on an inclined surface. Secondly, the configuration strengthens and stiffens the container. The configuration also provides a flat surface for an identification label or plate 30. Lastly, the storage capacity of the container 11 is increased permitting items such as shoes, hats and other accessories to be stored in the container 11 alongside the bag containing the clubs. The latches 19 are preferably positioned on opposite sides of the container 11 along what can be viewed as the minor axis of the ovate cross section of the container. This minor axis is indicated by dot-dash line 29 in FIG. 2.

The container bodies 12 and 13 are preferably blow molded from a tough, semi rigid plastic material such as polyethylene. The blow molding technique is particularly suitable for forming the various configurations required for the union means 18.

From the foregoing it will be appreciated that the invention provides a golf bag container having a number of improvements therein.

What is claimed is:

1. A shipping container for a golf bag, said container including (a) an upper hollow body including (i) a first generally tubular perimetrical side wall having an upper end and a lower open end, (ii) a top wall connected to said upper end of said side wall and enclosing said side wall, (iii) a first sleeve structure connected to and extending outwardly from said side wall, said sleeve structure being spaced away from said lower open end and intermediate said lower end and said upper end including spaced apart upper and lower contact surfaces each at an angle to said side wall;

(b) a lower hollow body including (i) a second generally tubular perimetrical side wall having an upper open end and a lower end, (ii) a lower wall connected to said lower end of said second side wall and enclosing said side wall of said lower body, (iii) a second sleeve structure connected to and extending outwardly from said second side wall, said second sleeve structure including a primary support surface extending outwardly from and at an angle to said second side wall on a side of said second side wall adjacent said upper open end, said first and second sleeve structures and upper and lower bodies being shaped, contoured, and dimensioned such that said upper body is movable between at least two operative positions, (c) a first operative position with (i) said lower end of said upper body slidably received by said lower body and within and at least partially circumscribed by said second sleeve structure, and (ii) said lower contact surface bearing against said primary support surface; and, (d) a second operative position with (i) said upper body inverted from said first operative position, (ii) said portion of said first side wall of said upper body intermediate said sleeve structure and said top wall extending downwardly inside said lower hollow body;

(iii) said upper contact surface bearing against said primary support surface, and (iv) said lower open end opening outwardly away from said first and second sleeve structures.

2. The shipping container of claim 1 including (a) at least one recess formed in said first and second sleeve structures and completely circumscribed by said first and second sleeve structures when said upper body is in said first operative position, said recess including (i) a first recess portion partially circumscribed by said first sleeve structure, and (ii) a second recess portion partially circumscribed by said second sleeve structure; and, (b) latch means mounted in said recess;

said first and second sleeve structures and said recess being shaped and dimensioned such that when said upper body is in said second operative position, a portion of said first sleeve structure and of said upper contact surface extends intermediate said first and second recess portions;

said mounting of said latch means in said recess protecting said latch means against dislodgement during shipping.

3. The shipping container of claim 2 wherein said upper and lower hollow bodies are blow molded from a plastic material.

4. The shipping container of claim 3 wherein said upper and lower bodies have ovate cross-sections.

5. The shipping container of claim 2 including a carrying strap positioned in an elongate recess extending along said sidewalls of said upper and lower bodies.

6. The shipping container of claim 2 wherein
(a) said upper and lower contact surfaces extend substatinally around said first side wall; and,
(b) said primary support surface extends substantially around said second side wall.

7. The shipping container of claim 4 wherein
(a) said upper and lower contact surfaces extend substatinally around said first side wall; and,
(b) said primary support surface extends substantially around said second side wall.

8. A shipping container for a golf bag, said container including
(a) an upper hollow body including
(i) a first generally tubular perimetrical side wall having an upper end and a lower open end,
(ii) a top wall connected to said upper end of said side wall and enclosing said side wall,
(iii) a first sleeve structure connected to and extending outwardly from said side wall, said sleeve structure
being spaced away from said lower open end and intermediate said lower end and said upper end
including spaced apart upper and lower contact surfaces each at an angle to said side wall;
an outer surface extending at least partly around said upper body, and
(iv) a tubular section including a portion of said side wall extending from said lower end to said first sleeve structure;
(b) a lower hollow body including
(i) a second generally tubular perimetrical side wall having an upper open end and a lower end,
(ii) a lower wall connected to said lower end of said second side wall and enclosing said second sidewall,
(iii) a second sleeve structure connected to and extending outwardly from said second side wall, said second sleeve structure including a primary support surface extending outwardly from and at an angle to said second side wall on a side of said second side wall adjacent said upper open end,
said first and second sleeve structures and upper and lower bodies being shaped, contoured, dimensioned such that said upper body is movable between at least two operative positions,
(c) a first operative position with
(i) said lower end of said upper body slidably received by said lower body and within and at least partially circumscribed by said second sleeve structure, and
(ii) said lower contact surface bearing against said primary support surface and,
(iii) said tubular section slidably tightly received by said lower body; and,
(d) a second operative position with
(i) said upper body inverted from said first operative position,
(ii) said portion of said first side wall intermediate said first sleeve structure and said top wall extending downwardly inside said lower hollow body,
(iii) said upper contact surface bearing against said primary support surface, and
(iv) said lower open end opening outwardly away from said first and second sleeve structures.

9. The shipping container of claim 8 including
(a) at least one recess formed in said first and second sleeve structures and completely circumscribed by said first and second sleeve structures when said upper body is in said first operative position, said recess including
(i) a first recess portion partially circumscribed by said first sleeve structure, and
(ii) a second recess portion partially circumscribed by said second sleeve structure; and,
(b) latch means mounted in said recess;
said first and second sleeve structures and said recess being shaped and dimensioned such that when said upper body is in said second operative position, a portion of said first sleeve structure and of said upper contact surface extends intermediate said first and second recess portions;
said mounting of said latch means in said recess protecting said latch means against dislodgement during shipping.

10. The shipping container of claim 9 wherein said upper and lower hollow bodies are blow molded from a plastic material.

11. The shipping container of claim 10 wherein said upper and lower bodies have ovate cross-sections.

12. The shipping container of claim 9 including
(a) an elongate recess extending along said sidewalls of said upper and lower bodies, and
(b) a carrying strap positioned in said elongate recess of said upper and lower bodies.

13. The shipping container of claim 9 wherein
(a) said upper and lower contact surfaces extend substantially around said first side wall; and,
(b) said primary support surface extends substantially around said second side wall.

14. The shipping container of claim 10 wherein
(a) said upper and lower contact surfaces extend substantially around said first side wall; and,
(b) said primary support surface extends substantially around said second side wall.

15. The shipping container of claim 12 wherein
(a) said upper and lower contact surfaces extend substantially around said first side wall; and,
(b) said primary support surface extends substantially around said second side wall.

* * * * *